US012460537B2

(12) United States Patent
Treiberg et al.

(10) Patent No.: US 12,460,537 B2
(45) Date of Patent: Nov. 4, 2025

(54) DEVICES, SYSTEMS, AND METHODS FOR DETECTING THE ROTATION OF ONE OR MORE COMPONENTS FOR USE WITH A WELLBORE

(71) Applicant: CHAMPIONX LLC, Sugar Land, TX (US)

(72) Inventors: Terry Treiberg, Bakersfield, CA (US); Terry Wright, Lequire, OK (US); Eric Larson, Johnstown, CO (US)

(73) Assignee: CHAMPIONX LLC, Sugar Land, TX (US)

( * ) Notice: Subject to any disclaimer, the term of this patent is extended or adjusted under 35 U.S.C. 154(b) by 744 days.

(21) Appl. No.: 17/549,519

(22) Filed: Dec. 13, 2021

(65) Prior Publication Data

US 2023/0184089 A1 Jun. 15, 2023

(51) Int. Cl.
*E21B 47/009* (2012.01)
*E21B 43/12* (2006.01)
*E21B 47/092* (2012.01)

(52) U.S. Cl.
CPC ..... *E21B 47/009* (2020.05); *E21B 43/127* (2013.01); *E21B 47/092* (2020.05)

(58) Field of Classification Search
CPC ..... E21B 47/009; E21B 43/127; E21B 47/092
See application file for complete search history.

(56) References Cited

U.S. PATENT DOCUMENTS

| | | | | |
|---|---|---|---|---|
| 3,343,409 | A † | 9/1967 | Gibbs | |
| 9,140,113 | B2 * | 9/2015 | Hurst | E21B 47/009 |
| 9,903,193 | B2 † | 2/2018 | Harding | |
| 10,167,707 | B2 † | 1/2019 | Trapani | |
| 11,319,794 | B2 * | 5/2022 | Fyfe | G01B 7/16 |
| 11,339,643 | B2 † | 5/2022 | Robison | |
| 11,542,938 | B2 † | 1/2023 | Zhao | |
| 11,572,770 | B2 † | 2/2023 | Sengul | |
| 2003/0236627 | A1 * | 12/2003 | Estes | E21B 47/022 702/9 |

(Continued)

OTHER PUBLICATIONS

International Search Report and Written Opinion, mailed Oct. 15, 2015 in corresponding International Application No. PCT/US2015/032766 with International Filing Date of May 27, 2015.

(Continued)

*Primary Examiner* — Lisa M Caputo
*Assistant Examiner* — Michael J Singletary
(74) *Attorney, Agent, or Firm* — BKRIP LLC

(57) ABSTRACT

Sensor systems and methods for downhole pumping systems include a sensor subsystem for detecting movement of at least one component of the downhole pumping system. The sensor subsystem includes an axial motion sensor to be coupled to the at least one component of the downhole pumping system and to detect axial movement of the at least one component of the downhole pumping system and a rotational sensor to be coupled to the at least one component of the downhole pumping system and to detect rotational movement of the at least one component of the downhole pumping system by sampling rotational velocity values with the rotational sensor generated by rotation of the at least one component of the downhole pumping system.

20 Claims, 3 Drawing Sheets

(56) References Cited

U.S. PATENT DOCUMENTS

| | | | | |
|---|---|---|---|---|
| 2008/0035376 | A1* | 2/2008 | Freyer | E21B 12/00 702/9 |
| 2013/0181844 | A1 | 7/2013 | Hurst et al. | |
| 2019/0203579 | A1* | 7/2019 | Phillips | G01V 3/40 |
| 2020/0123892 | A1 | 4/2020 | Picon | |
| 2020/0263531 | A1 | 8/2020 | Fyfe et al. | |
| 2020/0340309 | A1 | 10/2020 | Cortes et al. | |
| 2020/0362686 | A1* | 11/2020 | Puwanto | E21B 21/10 |
| 2020/0392834 | A1 | 12/2020 | Sengul | |
| 2022/0236082 | A1† | 7/2022 | Navar | |

OTHER PUBLICATIONS

International Search Report and Written Opinion for PCT/US2022/049624, Feb. 16, 2023, 10 pages.

* cited by examiner
† cited by third party

DEVICES, SYSTEMS, AND METHODS FOR DETECTING THE ROTATION OF ONE OR MORE COMPONENTS FOR USE WITH A WELLBORE

TECHNICAL FIELD

The present disclosure relates to the detection of rotation of one or more components used in the production of fluid from a wellbore. More specifically, the present disclosure relates to the production of fluids from a wellbore using artificial lift and detecting the mechanical rotation of components during operation of a surface pumping unit and related assemblies, apparatuses, systems, and methods.

BACKGROUND

In a wellbore for the production of hydrocarbon fluids, a string of production tubing is run into the casing. The production tubing serves as a conduit for carrying production fluids to the surface. A packer is optionally set at a lower end of the production tubing to seal an annular area formed between the tubing and the surrounding strings of casing. In order to carry the hydrocarbon fluids to the surface, a pump may be placed at a lower end of the production tubing in order to produce the fluids through artificial lift. In some cases, oil wells undergoing artificial lift use a reciprocating plunger-type of pump. The pump has one or more valves that capture fluid on a downstroke, and then lift the fluid up on the upstroke through positive displacement.

Mechanically actuated downhole pumps generally build pressure to lift fluid to the surface. Reciprocal movement of the pump is induced by cycling a rod-string hung within the production tubing. The rod-string comprises a series of long, thin joints of steel bar that are threadedly connected through couplings. The rod-string is pivotally attached to a pumping unit at the surface. In response to movement of the pumping unit, the rod-string moves up and down within the production tubing to incrementally lift production fluids from a subsurface formation up to the surface.

The production of hydrocarbon fluids using a sucker rod pump creates friction and wear as the rods reciprocate up and down within the production tubing. Wellbore deviations and other factors may impart a side-load on the rod-string, resulting in friction and wear at deviation points. To mitigate this wear, it is desirable to rotate the rods during pumping to more evenly distribute wear along the circumference of the rods. This is accomplished by using a slow-moving gear, actuated through a ratchet mechanism by the stroking motion of the pumping unit.

Because the rotation is relatively very slow, it is difficult for the operator to visually observe rotation at the wellhead. For this reason, a failed rotation mechanism can go undetected for an extended period of time, sometimes weeks. A failed or otherwise ineffective rod rotator can result in premature failure due to uneven downhole rod or tubing wear. Further, adverse downhole conditions can prevent the rotational motion of the rotator from transferring torque to the rod string. Examples of such conditions include the presence of heavy crude, paraffin, or down-hole friction which may impede the fall of the rod string. This condition is known as rod float and can cause the polished rod clamp to briefly lift off the rod rotator table, losing the frictional contact and associated torque imparted on the rods. Additionally, dynamic conditions such as pump impact or fluid pound can cause the rotator and polished rod to briefly separate and lose the imparted torque. These conditions are virtually impossible to identify from a brief, onsite observation as they are transient.

SUMMARY

Embodiments of the instant disclosure may be directed to a sensor system for a downhole pumping system. The sensor system including a sensor subsystem for detecting movement of at least one component of the downhole pumping system. The sensor subsystem including: an axial motion sensor subsystem including a magnetometer, the magnetometer to be coupled to the at least one component of the downhole pumping system and to detect axial movement of the at least one component of the downhole pumping system based on variations in a magnet field detected by the magnetometer generated by movement of the at least one component of the downhole pumping system; and a rotation sensor subsystem including a gyroscope, the gyroscope to be coupled to the at least one component of the downhole pumping system and to detect rotational movement of the at least one component of the downhole pumping system by detecting rotational velocity values with the gyroscope generated by rotation of the at least one component of the downhole pumping system. The sensor system further including a processor subsystem to receive data from the axial motion sensor subsystem and the rotation sensor subsystem, the processor subsystem to: determine axial movement of the at least one component of the downhole pumping system with the axial motion sensor subsystem; and determine rotational velocity of the at least one component of the downhole pumping system with the rotation sensor subsystem by sampling rotational velocity values generated by the rotation of the at least one component of the downhole pumping system with the gyroscope.

In some aspects, embodiments described herein relate to a sensor system for a downhole pumping system. The sensor system including: a sensor subsystem for detecting movement of at least one component of the downhole pumping system, the sensor subsystem including: an axial motion sensor subsystem including an axial motion sensor, the axial motion sensor to be coupled to the at least one component of the downhole pumping system and to detect axial movement of the at least one component of the downhole pumping system based on variations detected by the axial motion sensor generated by movement of the at least one component of the downhole pumping system; and a rotation sensor subsystem including a rotational sensor, the rotational sensor to be coupled to the at least one component of the downhole pumping system and to detect rotational movement of the at least one component of the downhole pumping system by sampling rotational velocity values with the rotational sensor generated by rotation of the at least one component of the downhole pumping system. The sensor system further including a processor subsystem to receive data from the axial motion sensor subsystem and the rotation sensor subsystem, the processor subsystem to: verify the axial movement of the at least one component of the downhole pumping system with the axial motion sensor subsystem; and when the axial movement has been verified, determine rotational velocity of the at least one component of the downhole pumping system with the rotational velocity values detected by the rotation sensor subsystem.

In some aspects, embodiments described herein relate to a sensor system for a downhole pumping system, The sensor system including: a sensor subsystem for detecting movement of a tubing rotator of the downhole pumping system, the sensor subsystem including a rotation sensor subsystem including a rotational sensor, the rotational sensor to be coupled to the tubing rotator of the downhole pumping system and to detect rotational movement of the tubing rotator of the downhole pumping system by sampling rotational velocity values with the rotational sensor generated by rotation of the tubing rotator of the downhole pumping system. The sensor system further including a processor subsystem to receive data from the rotation sensor subsystem, the processor subsystem to determine rotational velocity of the tubing rotator of the downhole pumping system with the rotational velocity values detected by the rotation sensor subsystem.

In some aspects, embodiments described herein relate to a method of detecting motion of at least one component of a downhole pumping system. The method including: detecting axial movement of at least one component of the downhole pumping system based on variations detected by an axial motion sensor coupled to the at least one component of the downhole pumping system generated by translation of the at least one component of the downhole pumping system; detecting rotational movement of the at least one component of the downhole pumping system with a rotational sensor generated by rotation of the at least one component of the downhole pumping system; and verifying axial movement of the at least one component of the downhole pumping system with the axial motion sensor before the detecting of the rotational movement of the at least one component of the downhole pumping system with the rotational sensor.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

DETAILED DESCRIPTION

Figure 1:
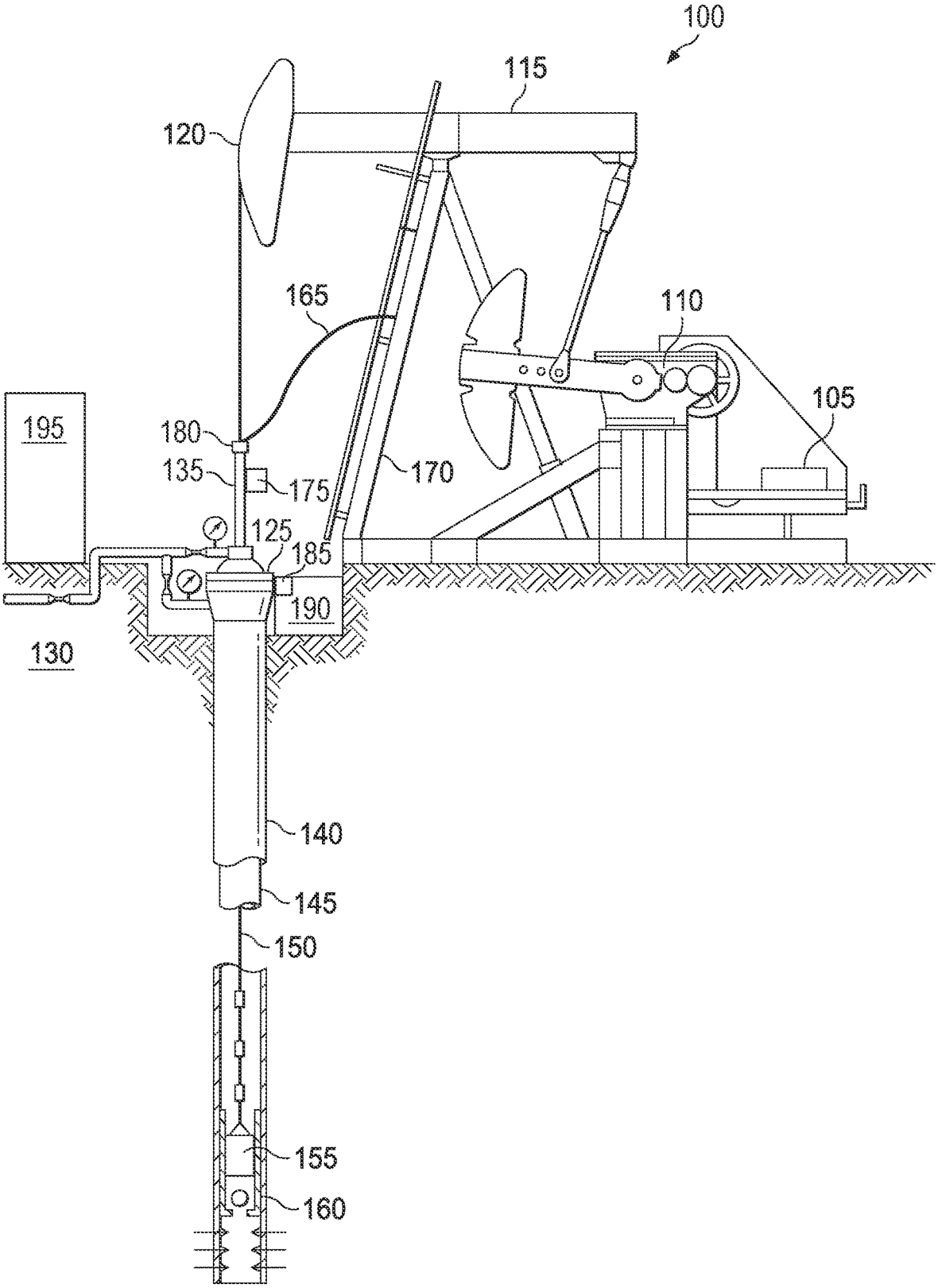
FIG. 1 is an elevational view of a pumping system according to embodiments of the disclosure.

In the following detailed description, reference is made to the accompanying drawings, which form a part hereof, and in which are shown, by way of illustration, specific example embodiments in which the present disclosure may be practiced. These embodiments are described in sufficient detail to enable a person of ordinary skill in the art to practice the present disclosure. However, other embodiments may be utilized, and structural, material, and process changes may be made without departing from the scope of the disclosure. The illustrations presented herein are not meant to be actual views of any particular method, system, device, or structure, but are merely idealized representations that are employed to describe the embodiments of the present disclosure. The drawings presented herein are not necessarily drawn to scale. Similar structures or components in the various drawings may retain the same or similar numbering for the convenience of the reader; however, the similarity in numbering does not mean that the structures or components are necessarily identical in size, composition, configuration, or any other property.

It will be readily understood that the components of the embodiments as generally described herein and illustrated in the drawings could be arranged and designed in a wide variety of different configurations. Thus, the following description of various embodiments is not intended to limit the scope of the present disclosure, but is merely representative of various embodiments. While the various aspects of the embodiments may be presented in drawings, the drawings are not necessarily drawn to scale unless specifically indicated.

Furthermore, specific implementations shown and described are only examples and should not be construed as the only way to implement the present disclosure unless specified otherwise herein. Elements, circuits, and functions may be shown in block diagram form in order not to obscure the present disclosure in unnecessary detail. Conversely, specific implementations shown and described are exemplary only and should not be construed as the only way to implement the present disclosure unless specified otherwise herein. Additionally, block definitions and partitioning of logic between various blocks is exemplary of a specific implementation. It will be readily apparent to one of ordinary skill in the art that the present disclosure may be practiced by numerous other partitioning solutions. For the most part, details concerning timing considerations and the like have been omitted where such details are not necessary to obtain a complete understanding of the present disclosure and are within the abilities of persons of ordinary skill in the relevant art.

Those of ordinary skill in the art would understand that information and signals may be represented using any of a variety of different technologies and techniques. For example, data, instructions, commands, information, signals, bits, symbols, sensors, and chips that may be referenced throughout this description may be represented by voltages, currents, electromagnetic waves, magnetic fields or particles, optical fields or particles, or any combination thereof. Some drawings may illustrate signals as a single signal for clarity of presentation and description. It will be understood by a person of ordinary skill in the art that the signal may represent a bus of signals, wherein the bus may have a variety of bit widths and the present disclosure may be implemented on any number of data signals including a single data signal.

The various illustrative logical blocks, modules, and circuits described in connection with the embodiments disclosed herein may be implemented or performed with a general purpose processor, a special purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, such as a combination of a DSP and a microprocessor, a plurality of microprocessors, one or more microprocessors in conjunction with a DSP core, or any other such configuration. A general-purpose computer including a processor is considered a special-purpose computer while the general-purpose computer is configured to execute computing instructions (e.g., software code) related to embodiments of the present disclosure.

Also, it is noted that the embodiments may be described in terms of a process that is depicted as a flowchart, a flow diagram, a structure diagram, or a block diagram. Although a flowchart may describe operational acts as a sequential process, many of these acts can be performed in another sequence, in parallel, or substantially concurrently. In addition, the order of the acts may be rearranged. A process may correspond to a method, a thread, a function, a procedure, a subroutine, a subprogram, etc. Furthermore, the methods disclosed herein may be implemented in hardware, software, or both. If implemented in software, the functions may be stored or transmitted as one or more instructions or code on computer-readable media. Computer-readable media includes both computer storage media and communication media including any medium that facilitates transfer of a computer program from one place to another.

Several aspects of the embodiments disclosed herein may be implemented as software modules or components. As used herein, a software module or component may include any type of computer instruction or computer-executable code located within a memory device that is operable in conjunction with appropriate hardware to implement the programmed instructions. A software module or component may, for instance, comprise one or more physical or logical blocks of computer instructions, which may be organized as a routine, program, object, component, data structure, etc., that performs one or more tasks or implements particular abstract data types.

In certain embodiments, a particular software module or component may comprise disparate instructions stored in different locations of a memory device, which together implement the described functionality of the module. Indeed, a module or component may comprise a single instruction or many instructions, and may be distributed over several different code segments, among different programs, and across several memory devices. Some embodiments may be practiced in a distributed computing environment where tasks are performed by a remote processing device linked through a communications network. In a distributed computing environment, software modules or components may be located in local and/or remote memory storage devices. In addition, data being tied or rendered together in a database record may be resident in the same memory device, or across several memory devices, and may be linked together in fields of a record in a database across a network.

Embodiments may be provided as a computer program product including a non-transitory machine-readable medium having stored thereon instructions that may be used to program a computer or other electronic device to perform processes described herein. The non-transitory machine-readable medium may include, but is not limited to, hard drives, floppy diskettes, optical disks, CD-ROMs, DVD-ROMs, ROMs, RAMs, EPROMs, EEPROMs, magnetic or optical cards, solid-state memory devices, or other types of media/machine-readable media suitable for storing electronic instructions.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, the term "and/or" means and includes any and all combinations of one or more of the associated listed items.

As used herein, the terms "vertical," "lateral," and "radial" refer to the orientations as depicted in the figures.

Embodiments of the disclosure may include systems including one or more remote wireless sensors (e.g., an array of sensors) that are implemented near a wellhead involved in the production of fluid (e.g., hydrocarbon) from a wellbore. Such sensors may provide enhancements in detecting and preventing failures during the production of the fluid. For example, a rod rotator sensor may be used to detect when the rod rotator is not functioning properly. Rod rotators that fail to operate lead to premature failures of rods and tubing. A wireless sensor may be installed on the rod string above the rod clamp and/or below a carrier bar. The sensor may include a rotational sensor (e.g., a gyroscope) to measure rotational velocity and a magnetometer to measure axial movement in order to provide detection of proper rotation of the rods. This detected data may be reported back through the point of connection at the wellhead and displayed in associated local or remote software for use and reference for an operator.

In some embodiments, the sensors may be used to detect rod string vibration. Such vibration detection may be used to detect fluid pound/tagging, high friction, and/or other rod motion anomalies. By tracking accurate rod position, along with the addition of a force sensor, such as a load cell, may provide a full load/position sensor. During operation, the rods generally exhibit vibrational motion as the rods slide up and down within the tubing. This vibration is amplified by excessive friction, obstruction, plunger hitting fluid on the downstroke, and/or other potential failures in the pumping system. By establishing a vibrational baseline during the stroke of a unit under normal circumstances, deviation from this baseline may be monitored and reported to prompt investigation into the cause of this deviation from baseline. The vibrational baseline may be derived from the sensor (e.g., an accelerometer) in three axes during the stroke of the pumping unit. A configurable limit may be established to alert the operator when the current vibrations exceed this limit.

In some embodiments, sensors (e.g., accelerometer and/or vibration sensor) may be used with other components of the pumping unit system to facilitate early detection of equipment failure, such as, for example, beams, gearboxes, and/or other components.

For example, the sensors may be implemented with a tubing rotator, which serves to reduce wear in the tubing, similar to how a rod rotator reduces wear in the rods. Tubing rotators are mechanical devices that are prone to failure where a sensor may report back the proper functioning of the rotator. In some embodiments, the tubing rotator sensor may use similar or the same components as the rod rotator sensor. However, as the orientation of the rotating shaft is horizontal (e.g., substantially parallel to the surface of the Earth on which the pumping system is positioned), the gyro axis may be aligned to a different plane. In some embodiments, the tubing rotator sensor may use an accelerometer to measure the tilt of the sensor as it rotates about the horizontal axis.

The present disclosure relates, in some embodiments, to gear rod systems used in a reciprocating sucker rod pumping systems (e.g., pumping system 100) that transport oil from oil wells. Such sucker rod pumping systems 100 may function on the positive displacement principle used by cylinder and piston pumps. FIG. 1 illustrates the basic components of a sucker rod pumping system 100. As shown in FIG. 1, the basic sucker rod pumping system 100 components include a motor base 105, a gearbox 110, a walking beam 115, a horsehead 120, a wellhead 125, a flowline 130, a polished rod 135, a casing 140, a tubing 145, a rod string 150, a plunger 155, cable 165, Samson beam 170, and a barrel 160.

The motor base 105 provides the driving power to the system 100 and can be an electric motor or a gas engine. The gearbox 110 reduces the high rotational speed of the motor base 105 into the reciprocating motion required to operate the downhole pump. The main element of the gearbox 110, the walking beam 115, functions as a mechanical lever that adjusts the position of the horsehead 120 that is connected to the polished rod 135. The Samson beam 170 serves as a vertical stabilizing leg to hold up the horsehead 120 and the walking beam 115. The Samson beam 170 can be connected through a cable 165 to the polished rod. The horsehead 120 translates the rotational motion from the motor base 105 into the reciprocating motion of the polished rod 135, which reciprocates through the wellhead 125 and into the oil well. At the end of the polished rod 135 or a string of sucker rods is the plunger 155 that is the main mechanical driver of fluid out of the oil well. Around the polished rod 135 and within the oil well is a casing 140 that surrounds tubing 145. Together, the casing 140 and tubing 145 form a casing-tubing annulus that surrounds the sub-surface pump system components. Sucker rod string 150, composed of sucker rods, runs inside the tubing string of the well and provides the mechanical link between the surface drive and the subsurface pump. The pump barrel 160 or working barrel is the stationary part of the subsurface pump that serves as a stopping point for the plunger 155. The barrel 160 generally contains a standing valve that acts together with the plunger 155 as a suction valve through which well fluids enter the pump barrel during an upstroke.

As discussed above, as the sucker rod string 150 reciprocates (e.g., translates) within the well, the sucker rod string 150 may asymmetrically wear through rod-on-tubing friction. This friction may increase in cases with crooked wells, cases with fluid or gas over-pressurization, and situations where there is tubing or rod buckling. To help minimize this uneven wear, the gradual rotation of the polished rod and/or the tubing in which the rod is translated is used to balance the wear may be implemented to substantially increase their operating life.

In order to monitor the rotation of one or more components of the pumping system 100 (e.g., the polished rod 135 and/or the tubing 145), a sensor system may be used. For example, a rod sensor 175 may be secured to a movable portion of the pumping system 100 (e.g., the polished rod 135). The rod sensor 175 may monitor the rotation of the polished rod 135 about an axis along which the polished rod 135 extends into the wellbore (e.g., about the longitudinal axis of the polished rod 135) as a rod rotator 180 gradually rotates the polished rod 135 during strokes of the sucker rod string 150. In some embodiments, the rod rotator 180 may be similar to those disclosed in U.S. Patent Application Publication No. US 2020/0340309 A1, the disclosure of which is incorporated herein, in its entirety, by this reference.

In additional embodiments, a tubing sensor 185 may be coupled to a portion of a tubing rotator 190. As discussed above, the tubing rotator 190 may rotate the tubing 145 in order to spread wear caused by the translation of the polished rod 135 and the sucker rod string 150 over the inner surface of the tubing 145. In some embodiments, the tubing rotator 190 may include a worm drive the interaction with a worm wheel coupled to the tubing 145. The tubing sensor 185 may be coupled to a portion of the worm drive of the tubing rotator 190 in order to monitor the rotation of the tubing rotator 190 directly. The tubing sensor 185 may monitor the rotation of the tubing rotator 190 (e.g., the worm drive) about an axis that extends along a surface of the Earth on which the pumping system 100 is positioned. For example, the rotational path of the tubing sensor 185 may extend in a direction (e.g., lie in a plane) that is substantially perpendicular to a surface upon which the downhole pumping system 100 is positioned.

In additional embodiments, the tubing sensor 185 may be coupled to a portion of the tubing 145 in order to directly monitor the rotation of the tubing 145.

The sensor system may include a base unit 195 (e.g., a stationary point of connection) that communicates (e.g., wirelessly communicates via radio waves without the use of an electrical conductor between two or more components) with one or more of the sensors (e.g., the rod sensor 175 and/or tubing sensor 185) of the sensor system coupled to movable components of the pumping system 100. The base unit 195 may be in communication with additional systems, such as, operational systems of the overall pumping system 100. For example, an operator of the pumping system 100 may receive data from the wireless the rod sensor 175 and/or tubing sensor 185 via the base unit 195 as the movable wireless sensors 175, 185 provide data relating to the operation of the components on which the wireless sensors 175, 185 are mounted.

Figure 2:
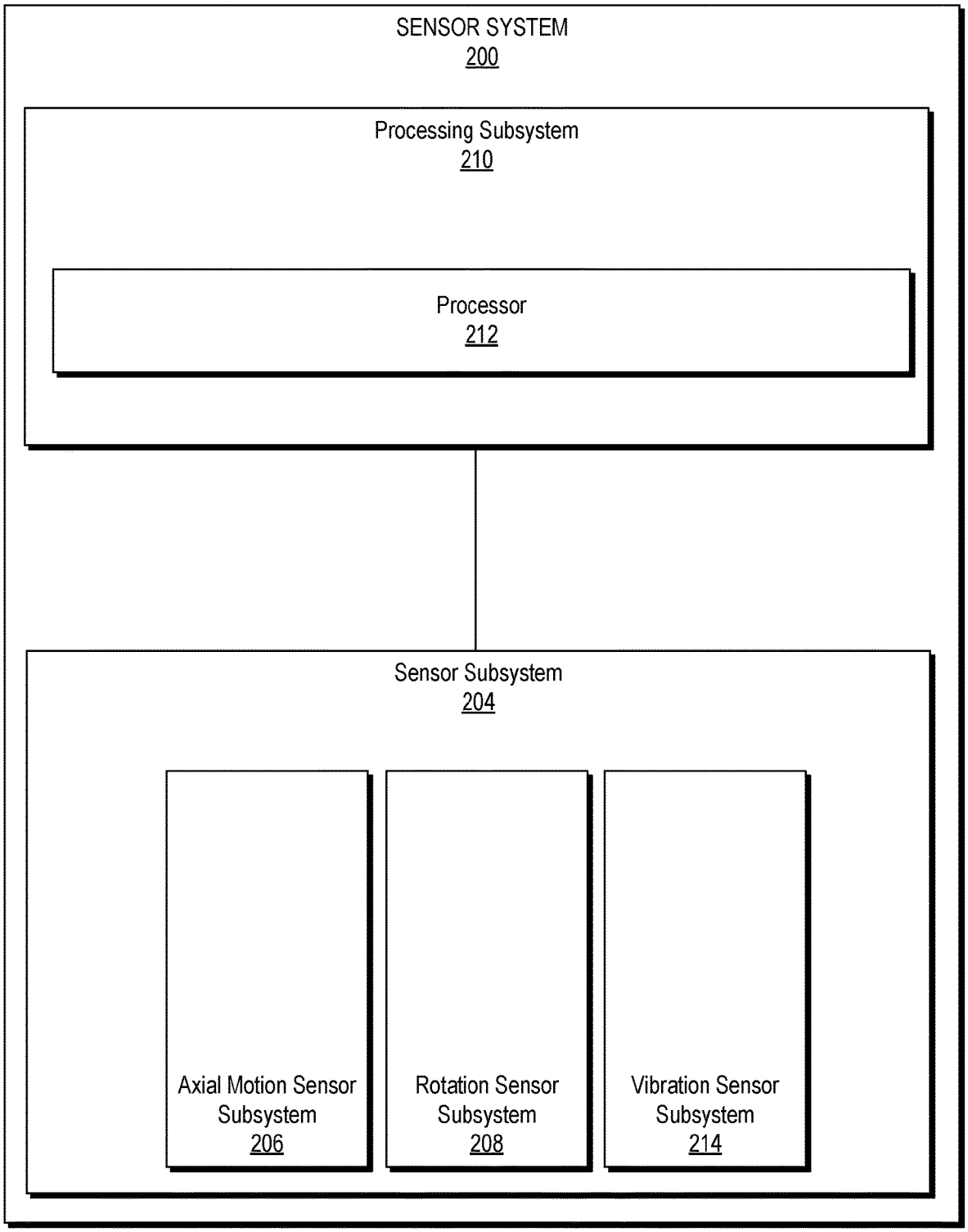
FIG. 2 illustrates a simplified representation of a sensor system for use in a pumping system to perform a plurality of functions in accordance with embodiments of the present disclosure.

FIG. 2 illustrates a simplified representation of a sensor system 200 for use in a pumping system (e.g., the pumping system 100 shown in FIG. 1). As shown in FIGS. 1 and 2, the sensor system 200 may include a sensor subsystem 204 for detecting movement of at least one component of the downhole pumping system 100. In some embodiments, the rod sensor 175 and/or tubing sensor 185 may each include such a sensor subsystem 204. The sensor subsystem 204 may include sensors for sensing various types of motion of the components of the downhole pumping system 100 as discussed below. In some embodiments, the sensor subsystem 204 may include sensors that are self-calibrating, wireless, and/or independently powered (e.g., battery-powered). In some embodiments, these sensors or others sensors may measure conductivity, temperature, humidity, acoustics, load, etc.

The sensor subsystem 204 may include an axial motion sensor subsystem 206 including one or more sensors for detecting linear movement (e.g., a magnetometer, a capacitive sensor, a Hall effect sensor, an optical sensor, etc.). For example, the axial motion sensor subsystem 206, which may be contained in the sensors 175, 185 may be coupled to one or more components (e.g., the polished rod 135) of the downhole pumping system 100 to detect axial movement of the polished rod 135 of the downhole pumping system 100. In embodiments where the axial motion sensor subsystem 206 includes a magnetometer, the axial motion of the polished rod 135 may be monitored based on variations in a magnetic field detected by the magnetometer generated by movement of the polished rod 135 of the downhole pumping system 100. For example, the magnetic field surrounding the polished rod 135 and the nearby metallic structures (e.g., the wellhead 125) may provide a sinusoidal-type waveform in the magnetometer that can be monitored to determine when the polished rod 135 changes axial (e.g., vertical) direction (e.g., during an up and down stroke of the polished rod 135).

The sensor subsystem 204 may include a rotation sensor subsystem 208 including a sensor for determining rotational motion or a component thereof (e.g., a gyroscope, an accelerometer, etc.), The rotation sensor subsystem 208 may be coupled to one or more components (e.g., the polished rod 135 and/or the tubing rotator 190) of the downhole pumping system 100 to detect rotational movement of the polished rod 135 and/or the tubing rotator 190 of the downhole pumping system 100. For example, the rotation sensor subsystem 208 may be used to determine rotational velocity (e.g., by the sampling of rotational velocity values) generated by rotation of the polished rod 135 and/or the tubing rotator 190 of the downhole pumping system 100. In some embodiments, the rotation sensor subsystem 208 may comprise a gyroscope that monitors movement of the components of the downhole pumping system 100 in multiple degrees of freedom (e.g., nine degrees of freedom).

The sensor system 200 may include a processor subsystem 210 to receive data from the sensor subsystem 204 (e.g., the axial motion sensor subsystem 206 and/or the rotation sensor subsystem 208). The processor subsystem 210 may include one or more processors 212 for processing the data. In some embodiments, the processor subsystem 210 may be part of (e.g., physically located with) the movable sensors 175, 185, may be part of (e.g., physically located with) the base unit 195, or may be part of both the movable sensors 175, 185 and the base unit 195.

The processor subsystem 210 may determine axial movement of the polished rod 135 and/or the tubing rotator 190 of the downhole pumping system 100 with data from the axial motion sensor subsystem 204. The processor subsystem 210 may determine rotational velocity of the polished rod 135 and/or the tubing rotator 190 of the downhole pumping system 100 with data from the rotation sensor subsystem 208.

In some embodiments, data from the axial motion sensor subsystem 206 and the rotation sensor subsystem 208 may be used together (e.g., interrelated) to determine a condition of the downhole pumping system 100. For example, the processor subsystem 210 may use data from the axial motion sensor subsystem 206 to determine a direction change in the polished rod 135 (e.g., to determine when one part of a stroke of the polished rod 135 has been completed and/or to determine that a new stroke is beginning). Once the change in direction is noted, the angular velocity data detected the rotation sensor subsystem 208 may be sampled at relatively high frequency (e.g., 10 to 10,000 samples per second) to measure rotational velocity of the polished rod 135. When a second direction change of the polished rod 135 is determined, the sampling is continued. When the third direction change is noted (e.g., noting the completion of a complete up and down stoke), the sampling may be ceased.

In some embodiments, the sensor system 200 may only selectively detect the motion of the downhole pumping system 100 (e.g., in order to conserve battery life of the sensor system 200). The sensor system 200 may generally reside in a standby or sleep mode while only waking occasionally to detect movement of the downhole pumping system 100. For example, the sensor system 200 may selectively (e.g., periodically, based on an event, etc.) wake to detect the motion of the polished rod 135 during an entire stroke. Once the stroke is completed, the sensor system 200 may return to a sleep or standby mode.

The processor subsystem 210 may sum both positive and negative angular velocity measurements during the completed stroke to determine (e.g., to approximate) the overall net rotation of the polished rod 135 during the completed stroke. In some embodiments, the processor subsystem 210 may convert the overall net rotation to degrees of rotation per minute of the polished rod 135. If the angular velocity calculation yields a value above a preselected limit (e.g., a minimum amount of expected rotation), then confirmation of rotation may be indicted by the processor subsystem 210. Otherwise, rotation a failure in rotation may be noted. As noted above, similar monitoring and calculation may be utilized when monitoring rotation of the tubing rotator 190 and/or tubing 145 itself.

In such embodiments, verifying that the polished rod 135 is being moved (e.g., translated) by the downhole pumping system 100 may be useful to determine that the rod rotator 180 has actually failed to operate. For example, the sensor system 200 may continue to sample angular velocity only if it is determined that axial motion exists (e.g., with the axial motion sensor subsystem 206). Otherwise, the sensor system 200 may recognize no angular velocity or angular velocity under a certain threshold and incorrectly report that rod rotation has ceased when the polished rod 135 is not actually moving in the axial direction. The magnetic change near the axial motion sensor subsystem 206 will be substantially zero when there is no vertical motion of the polished rod 135. If little to no changes are noted in magnetic fields with the axial motion sensor subsystem 206, the sampling of the angular velocity may be aborted or discontinued when no vertical motion is reported.

In some embodiments, through the monitoring and reporting of the angular velocity, the number of rotations of the polished rod 135 during a selected period of time may be determined and used to evaluate the operation of the rod rotator 180. Components of the rod rotator 180 may degrade in performance over time, which often manifests in reduced velocity and reduced rotation over time. A reduced velocity of the rod rotator 180 may indicate an improper installation of the rod rotator 180, where a full stroke of the rotation mechanism of the rod rotator 180 may not be adequately occurring because of the installation orientation.

As noted above, velocity data the from rotation sensor subsystem 208 may be used to determine that the rod rotator 180 or other component is not properly rotating and/or may also be used to monitor for changes in the velocity data from a baseline or threshold amount and/or changes over time. For example, a detected decrease in velocity and/or one or more detected velocities that are below a selected threshold may be detected by the sensor system 200. Such data may be used to determine a performance characteristic of the downhole pumping system 100, such as, for example, if the rod rotator 180 is underperforming and/or showing signs of impending failure.

In some embodiments, the data from the axial motion sensor subsystem 206 may be used to determine the stroke period of the polished rod 135. Such a determination may be used to detect a condition of the well, for example, to detect a pumped-off condition.

In some embodiments, data from the rotation sensor subsystem 208 may be used to detect bridal oscillations caused by a fluid pound condition. The determination of the fluid pound condition may then be used to estimate the amount of pump fillage in the pumping operation.

In some embodiments, the sensor system 200 may include a vibration sensor subsystem 214 (e.g., load sensors, strain gauges, magnet sensors, accelerometers, gyroscopes, etc.) used to detect rod string vibration or vibration in other components of the downhole pumping system 100. As noted above, such vibration may be used to detect fluid pound/tagging, high friction, and/or other rod motion anomalies. The processor subsystem 210 may be used to establish a vibrational baseline during the stroke of the polished rod 135 under normal operational conditions. Detected deviation from this baseline may be monitored and reported to an operator of the downhole pumping system 100. In some embodiments, the vibrational baseline may be derived from the vibration sensor subsystem 214 in more than one axis (e.g., three axes) during the stroke of the downhole pumping system 100. A configurable limit may be established to alert the operator when the current vibrations exceed such a limit.

Figure 3:
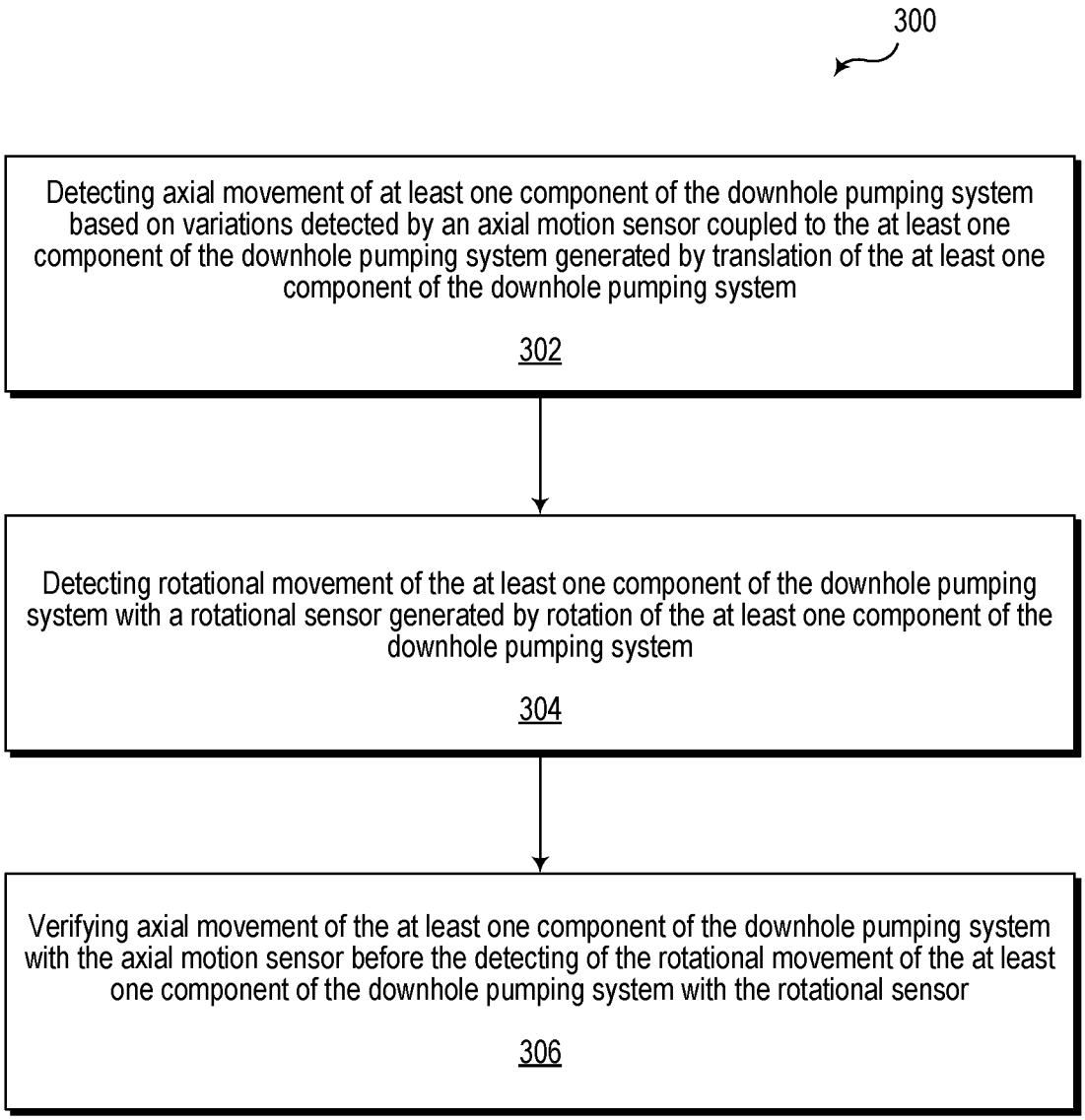
FIG. 3 illustrates a flow chart of a method of detecting motion of at least one component of the downhole pumping system in accordance with embodiments of the present disclosure.

FIG. 3 illustrates a flow chart of a method 300 of detecting motion of one or more components of the downhole pumping system (e.g., the polished rod 135 and/or the tubing 145 of the downhole pumping system 100 of FIG. 1). As shown in FIG. 3, and with further reference to FIG. 1, at act 302, axial motion of the component (e.g., the polished rod 135) may be detected based on variations detected by an axial motion sensor (e.g., rod sensor 175) coupled to the polished rod 135 of the downhole pumping system 100 generated by translation of the polished rod 135. At act 304, rotational movement of the (e.g., the polished rod 135 and/or the tubing 145) may be detected with a rotational sensor (e.g., the rod sensor 175 and/or tubing sensor 185) generated by rotation of the polished rod 135 and/or the tubing 145. At act 306, axial movement of the polished rod 135 may be verified with the rod sensor 175 before detecting (e.g., beginning to detect and/or continuing to detect) the rotational movement of the polished rod 135 and/or the tubing 145 with the rod sensor 175 and/or tubing sensor 185.

Terms of degree (e.g., "about," "substantially," "generally," etc.) indicate structurally or functionally insignificant variations, such as within acceptable manufacturing tolerances. In an example, when the term of degree is included with a term indicating quantity, the term of degree is interpreted to mean±10%, ±5%, or ±2% of the term indicating quantity. In an example, when the term of degree is used to modify a shape, the term of degree indicates that the shape being modified by the term of degree has the appearance of the disclosed shape. For instance, the term of degree may be used to indicate that the shape may have rounded corners instead of sharp corners, curved edges instead of straight edges, one or more protrusions extending therefrom, is oblong, is the same as the disclosed shape, et cetera.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. Further, the words "including," "having," and variants thereof (e.g., "includes" and "has") as used herein, including the claims, shall be open-ended and have the same meaning as the word "comprising" and variants thereof (e.g., "comprise" and "comprises"). In addition, features from one embodiment may be combined with features of another embodiment while still being encompassed within the scope of the disclosure as contemplated by the inventors.

What is claimed is:

1. A sensor system for a downhole pumping system, comprising:

a sensor subsystem for detecting movement of at least one component of the downhole pumping system, the sensor subsystem comprising:

an axial motion sensor subsystem comprising a magnetometer, the magnetometer to be coupled to the at least one component of the downhole pumping system and to measure axial movement of the at least one component of the downhole pumping system based on variations in a magnet field detected by the magnetometer generated by movement of the at least one component of the downhole pumping system;

a rotation sensor subsystem comprising a gyroscope, the gyroscope to be coupled to the at least one component of the downhole pumping system and to detect rotational movement of the at least one component of the downhole pumping system by detecting rotational velocity values with the gyroscope generated by rotation of the at least one component of the downhole pumping system; and a vibration sensor subsystem for monitoring vibration of the at least one component of the downhole pumping system in three axes; and a processor subsystem to receive data from the axial motion sensor subsystem and the rotation sensor subsystem, the processor subsystem to:

detect axial movement of the at least one component of the downhole pumping system with the magnetometer of the axial motion sensor subsystem, the detecting axial movement comprising:

sensing a direction change in the at least one component of the downhole pumping system to determine when a stroke of the at least one component of the downhole pumping system has been completed and to determine that a new stroke is beginning; and after the direction change in the at least one component of the downhole pumping system has been detected, begin to determine rotation of the at least one component of the downhole pumping system with the rotation sensor subsystem by sampling rotational values generated by the rotation of the at least one component of the downhole pumping system, the determining the rotational values of the at least one component of the downhole pumping system comprising:

continuing sampling the rotational values through a second direction change of the at least one component of the downhole pumping system; and ceasing sampling the rotational values at a third direction change of the at least one component of the downhole pumping system.

2. The sensor system of claim 1, wherein the sensor subsystem is configured to detect movement of the at least one component of the downhole pumping system comprising at least one rod of the downhole pumping system extending from a surface location into a wellbore.

3. The sensor system of claim 2, wherein the processor subsystem is configured to verify the axial movement and the direction change of the at least one rod before determining the rotation.

4. The sensor system of claim 2, wherein the processor subsystem is configured to determine the direction change of the at least one rod to indicate that a previous stoke has been completed and that a new stroke is beginning.

5. The sensor system of claim 4, wherein the processor subsystem is configured to begin sampling the rotational values comprising rotational velocity after determining the direction change of the at least one rod.

6. The sensor system of claim 1, wherein the processor subsystem is configured receive the rotational values from only a gyroscope.

7. The sensor system of claim 1, wherein the processor subsystem is configured to compare the sampled rotational values with previously sampled rotational values detected by the rotation sensor subsystem during a previous stroke of the downhole pumping system to determine if rotation of the at least one component of the downhole pumping system has occurred.

8. The sensor system of claim 1, wherein the sensor subsystem is configured to detect movement of the at least one component of the downhole pumping system comprising a tubing rotator of the downhole pumping system.

9. The sensor system of claim 8, wherein the sensor subsystem is configured to detect rotation of the tubing rotator while detecting axial movement of a polished of the downhole pumping system.

10. The sensor system of claim 1, wherein the processor subsystem is configured to determine the rotational values of the at least one component of the downhole pumping system by summing both positive and negative samples of the rotational values sensed by the rotation sensor subsystem.

11. The sensor system of claim 10, wherein the processor subsystem is configured to compare the determined rotational values of the at least one component of the downhole pumping system with an expected amount of rotational values to determine a failure in the rotation of the at least one component of the downhole pumping system.

12. The sensor system of claim 1, further comprising a vibration sensor subsystem for monitoring vibration of the at least one component of the downhole pumping system in three axes over a vibrational baseline.

13. A sensor system for a downhole pumping system, comprising:

a sensor subsystem for detecting movement of at least one component of the downhole pumping system, the sensor subsystem comprising:

an axial motion sensor subsystem comprising an axial motion sensor, the axial motion sensor to be coupled to the at least one component of the downhole pumping system and to measure axial movement of the at least one component of the downhole pumping system based on variations detected by the axial motion sensor generated by movement of the at least one component of the downhole pumping system; and a rotation sensor subsystem comprising a rotational sensor, the rotational sensor to be coupled to the at least one component of the downhole pumping system and to detect rotational movement of the at least one component of the downhole pumping system by sampling rotational values with the rotational sensor generated by rotation of the at least one component of the downhole pumping system; and a processor subsystem to receive data from the axial motion sensor subsystem and the rotation sensor subsystem, the processor subsystem to:

verify the axial movement of the at least one component of the downhole pumping system with the axial motion sensor subsystem;

when the axial movement has been verified, detecting the rotational values with the rotation sensor subsystem during a current stroke of the downhole pumping system; and comparing the rotational values with previously sensed rotational values detected by the rotation sensor subsystem during a previous stroke of the downhole pumping system to determine if rotation of the at least one component of the downhole pumping system has occurred.

14. The sensor system of claim 13, wherein the axial motion sensor subsystem comprises a magnetometer and the rotation sensor subsystem comprises a gyroscope.

15. The sensor system of claim 14, wherein the sensor subsystem is configured to detect movement of the at least one component of the downhole pumping system comprising at least one rod of the downhole pumping system extending from a surface location into a wellbore, and wherein the processor subsystem is configured to continue sampling the rotational values of the at least one rod over a stroke of the at least one rod.

16. A sensor system for a downhole pumping system, comprising:

an axial motion sensor subsystem comprising a magnetometer to measure axial movement of at least one component of the downhole pumping system and to determine a change in axial direction of the at least one component of the downhole pumping system;

a sensor subsystem for detecting movement of a tubing rotator of the downhole pumping system, the sensor subsystem comprising a rotation sensor subsystem comprising a rotational sensor, the rotational sensor to be coupled to the tubing rotator of the downhole pumping system and to detect rotational movement of the tubing rotator of the downhole pumping system by sampling rotational values with the rotational sensor generated by rotation of the tubing rotator of the downhole pumping system; and a processor subsystem to receive data from the rotation sensor subsystem, the processor subsystem to determine rotation of the tubing rotator of the downhole pumping system with the rotational values detected by the rotation sensor subsystem, the processor subsystem configured to:

detect the axial movement of the at least one component of the downhole pumping system with the axial motion sensor subsystem;

when the axial movement of the at least one component is detected, begin detecting the rotational movement of the tubing rotator of the downhole pumping system with the rotational sensor;

continue detecting the rotational movement of the tubing rotator of the downhole pumping system through a second direction change of the at least one component of the downhole pumping system; and cease detecting the rotational movement of the tubing rotator of the downhole pumping system after a third direction change of the at least one component of the downhole pumping system.

17. The sensor system of claim 16, wherein the rotation sensor subsystem comprises at least one of a gyroscope or an accelerometer.

18. The sensor system of claim 16, wherein the rotation sensor subsystem is configured to monitor the rotation of the tubing rotator along a path that extends in a direction substantially perpendicular to a surface upon which the downhole pumping system is positioned.

19. A method of detecting motion of at least one component of a downhole pumping system, the method comprising:

determining a first change in axial direction of at least one component of the downhole pumping system based on magnetic variations detected by an axial motion sensor coupled to the at least one component of the downhole pumping system generated by translation of the at least one component of the downhole pumping system;

when detecting no change in the axial direction, ceasing any sensing of rotation movement;

when verifying the first change in the axial direction:

begin detecting rotational movement of the at least one component of the downhole pumping system with a rotational sensor generated by rotation of the at least one component of the downhole pumping system;

continuing detecting the rotational movement of the at least one component of the downhole pumping system through a second direction change of the at least one component of the downhole pumping system; and ceasing detecting the rotational movement of the at least one component of the downhole pumping system after a third direction change of the at least one component of the downhole pumping system.

20. The method of claim 19, further comprising comparing a rotational velocity detected with the rotational sensor with a threshold value to determine a performance characteristic of the at least one component of the downhole pumping system.

* * * * *